United States Patent [19]

Schweiger

[11] Patent Number: 5,076,856

[45] Date of Patent: Dec. 31, 1991

[54] METHOD FOR CLEANING HEAT EXCHANGERS

[76] Inventor: Delano Schweiger, 9500 Winterbrook Way, Orangevale, Calif. 95662

[21] Appl. No.: 597,016

[22] Filed: Oct. 15, 1990

Related U.S. Application Data

[62] Division of Ser. No. 329,021, Mar. 27, 1989, Pat. No. 4,991,608.

[51] Int. Cl.[5] ..... B08B 9/00; B08B 7/04

[52] U.S. Cl. ..... 134/18; 134/22.11; 134/22.12; 134/22.18; 134/26; 134/169 C

[58] Field of Search ..... 134/22.11, 22.12, 22.13, 134/22.18, 26, 18, 95, 99, 102, 166 C, 168 C, 169 C

[56] References Cited

U.S. PATENT DOCUMENTS 2,189,950 11/1938 Gump ..... 134/26
2,458,333 1/1949 Brady, Jr. ..... 134/26

FOREIGN PATENT DOCUMENTS 1150045 4/1969 United Kingdom ..... 134/22.12

*Primary Examiner*—Theodore Morris
*Assistant Examiner*—Saeed Chaudhry
*Attorney, Agent, or Firm*—Mark C. Jacobs

[57] ABSTRACT

Apparatus and method for cleaning heat exchangers when overhauling transmissions or the like wherein the inlet and outlet of a heat exchanger is disconnected from the transmission and connected to a source of solvent, oil and air. Solvent is first injected into the heat exchanger in a direction reverse to the normal flow of oil through the heat exchanger. This injection of solvent is stopped, then started again after a predetermined delay time. This injection and delay cycle may be repeated.

Air is now injected under pressure into the heat exchanger in a direction reverse to the flow of oil therethrough, i.e. in the same direction as the solvent injection.

Thirdly, oil is injected into the heat exchanger in the normal direction of flow of oil therethrough for a predetermined time. This injection of oil is stopped for a predetermined period of time. The injection and delay cycle for oil injection may also be repeated.

Air is then injected under pressure through the heat exchanger in the normal direction of flow of oil therethrough. The cleaned and flushed heat exchanger may now be reconnected to the transmission.

5 Claims, 10 Drawing Sheets

METHOD FOR CLEANING HEAT EXCHANGERS

RELATION TO OTHER APPLICATIONS

This application is a division of U.S. Ser. No. 329,021 filed Mar. 27, 1989 now U.S. Pat. No. 4,991,608.

BACKGROUND OF THE INVENTION

1. Field of the Invention

The invention relates to the cleaning of contaminated oil from a heat exchanger; and, more particularly, to an apparatus and a method for flushing contaminated oil from a heat exchanger, which method utilizes reverse flow and cycle delay times for injection and soak as aspects thereof.

2. Description of the Prior Art

When a vehicle transmission is overhauled, it is imperative that all contaminated oil therein be flushed from the vehicle cooling system, and that the oil be totally clean. If this is not done properly, contaminated oil could remain in the lines and heat exchanger, and when the contaminated oil goes right back into the newly overhauled transmission, it can cause the latter to soon fail. The valve body will pick up the contaminated oil and the valves will stick and the plates will burn.

In the prior art, it is known to flush such heat exchangers with clean mineral oil which is flowed through the heat exchanger in the normal direction of flow of oil therethrough. This does not completely flush out the contaminated oil nor break up particles of contaminants therein.

There is thus a need for apparatus and method for completely flushing contaminated oil from heat exchangers of a vehicle or the like when the transmission is overhauled.

SUMMARY OF THE INVENTION

It is an object of this invention to provide apparatus for totally and completely removing contaminated oil from a vehicle heat exchanger or the like when the transmission is overhauled.

It is a further object of this invention to provide an improved method for totally and completely removing contaminated oil from a vehicle heat exchanger when the transmission is overhauled.

It is a still further object of this invention to carry out the foregoing objects wherein cleaning solvent is injected through the heat exchanger in a direction reverse to the normal flow of oil therethrough, then allowed to soak with a subsequent injection of air under pressure in the same direction. This is followed by an injection of oil through the heat exchanger in the normal direction of flow of oil therethrough, followed by a soak period and again air injection.

It is still another object of the invention to carry out the foregoing procedure by repeating the solvent injection and soak cycle, and by repeating the oil injection and soak cycle, both repeated cycles being made before the injection of air.

These and other objects are preferably accomplished by providing a source of cleaning solvent, oil and air under pressure. Solvent is injected through a heat exchanger, which exchanger has been disconnected from a transmission, in the reverse direction of the flow of oil therethrough. This is done for a predetermined period of time, followed by a stopping of the injection of solvent for a soak period for a predetermined period of time. This injection and soak period may be repeated.

Air is now injected under pressure into the heat exchanger in the normal direction of flow of oil therethrough for a predetermined time period followed by a soak period for a predetermined period of time. This injection and soak period for the oil may be repeated. Air is now injected under pressure in the normal direction of flow of oil through the heat exchanger to purge the same. The cleaned and flushed heat exchanger may now be reconnected to the transmission. All lines, hoses, filters, etc. of the heat exchanger may thus be cleaned in a single operation.

DESCRIPTION OF THE PREFERRED EMBODIMENT

Figure 1:
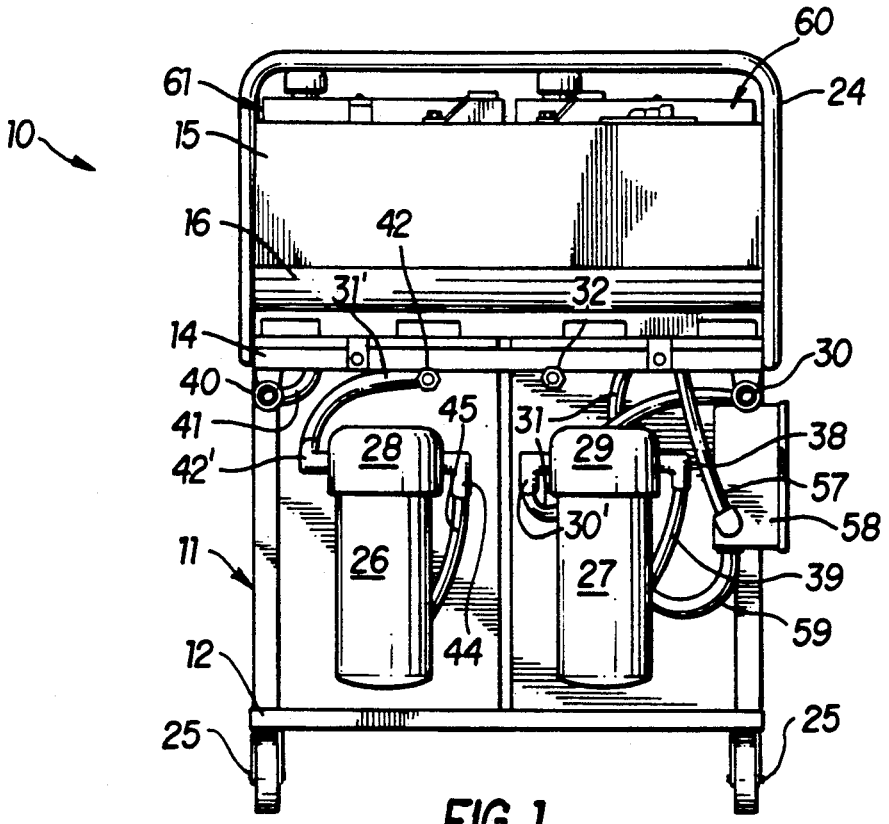
FIG. 1 is a vertical front view of the apparatus of the invention.
Figure 2:
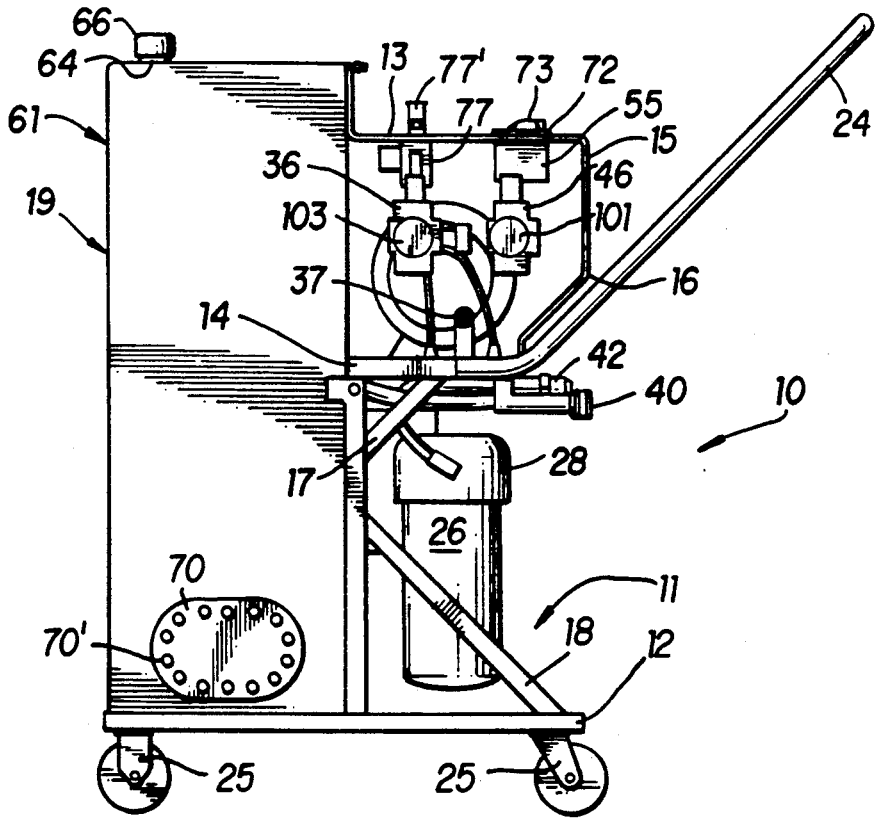
FIG. 2 is a vertical side view of the apparatus of the invention.
Figure 3:
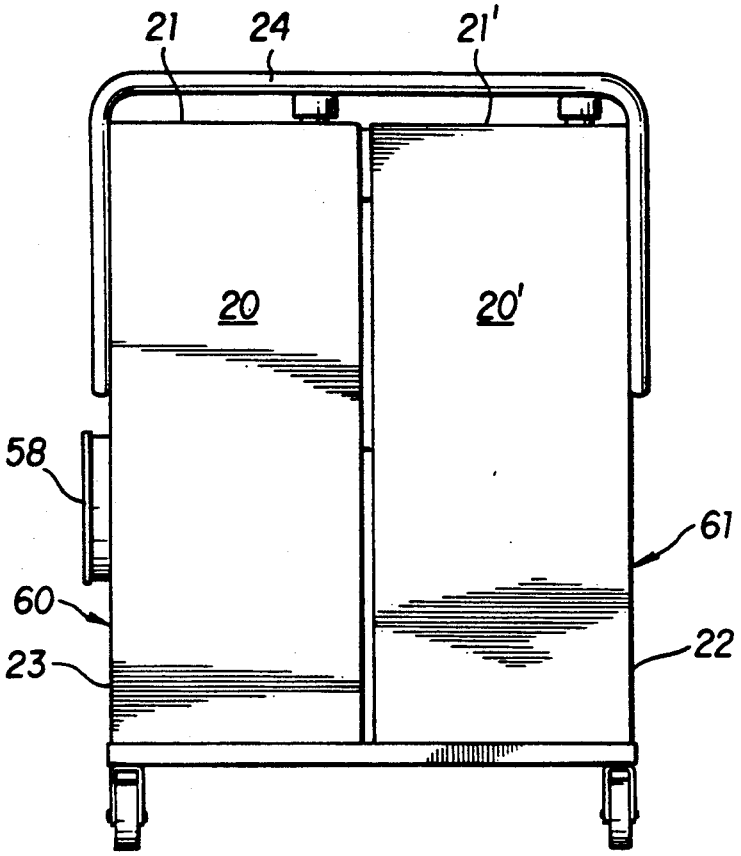
FIG. 3 is a vertical rear view of the apparatus of the invention.

Referring now to FIG. 1 of the drawing, wherein apparatus 10 is shown which apparatus is used to remove contaminated oil from the heat exchanger or transmission oil cooling system of a vehicle or the like. Apparatus 10 thus includes a housing 11 having a bottom wall 12, a top wall 13 (FIG. 2) and an intermediate partition wall 14. The walls 13, 14 may be interconnected by an upper front wall 15 (FIGS. 1 and 2) which front wall has a lower portion 16 that extends downwardly and inwardly as seen in FIG. 2. One or more side angle braces, such as upper and lower braces 17, 18 (FIG. 2) may extend from a rear housing 19 up to partition wall 14 and down to bottom wall 12, respectively, as shown. Rear housing 19 is divided into two separate compartments 60, 61 (as will be discussed) and each of these compartments has a rear wall 20, 20', respectively. Each compartment 60, 61 has a top wall 21, 21', respectively, (FIG. 3). Each compartment 60, 61 (FIGS. 2 and 4) also has spaced side walls, only side walls 22, 23 being visible.

A U-shaped handle 24 (FIG. 2) may be provided coupled to wall 14 on both sides thereof. A plurality of roller assemblies or casters 25 may be provided on the underside of bottom wall 12 for wheeling the apparatus 10 from place to place.

Figure 5:
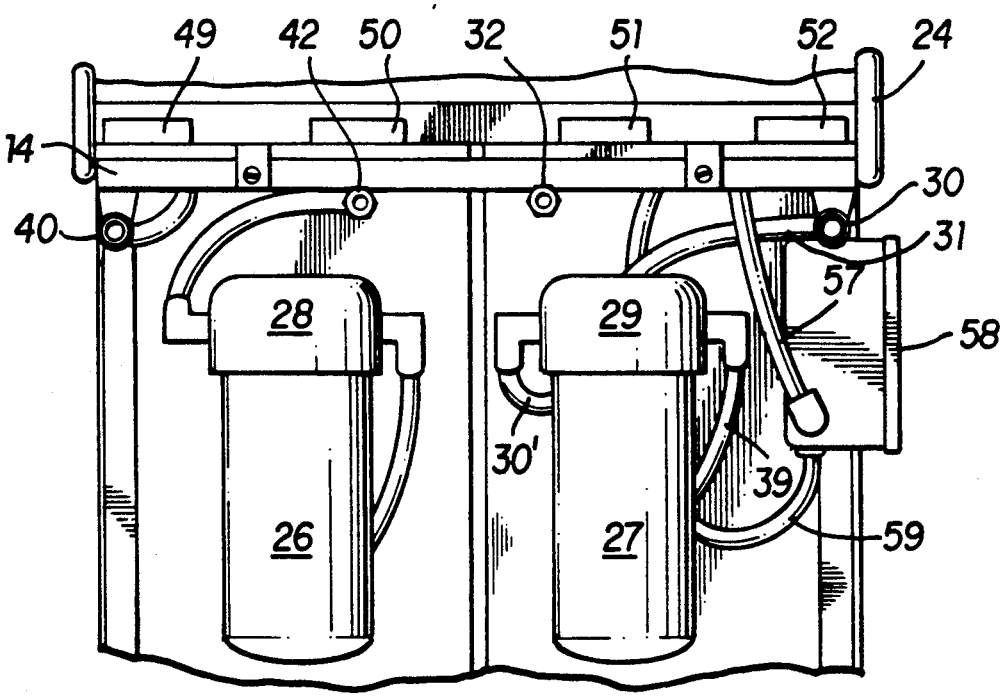
FIG. 5 is a detailed front view of a portion of the apparatus of FIGS. 1 to 4.
Figure 6:
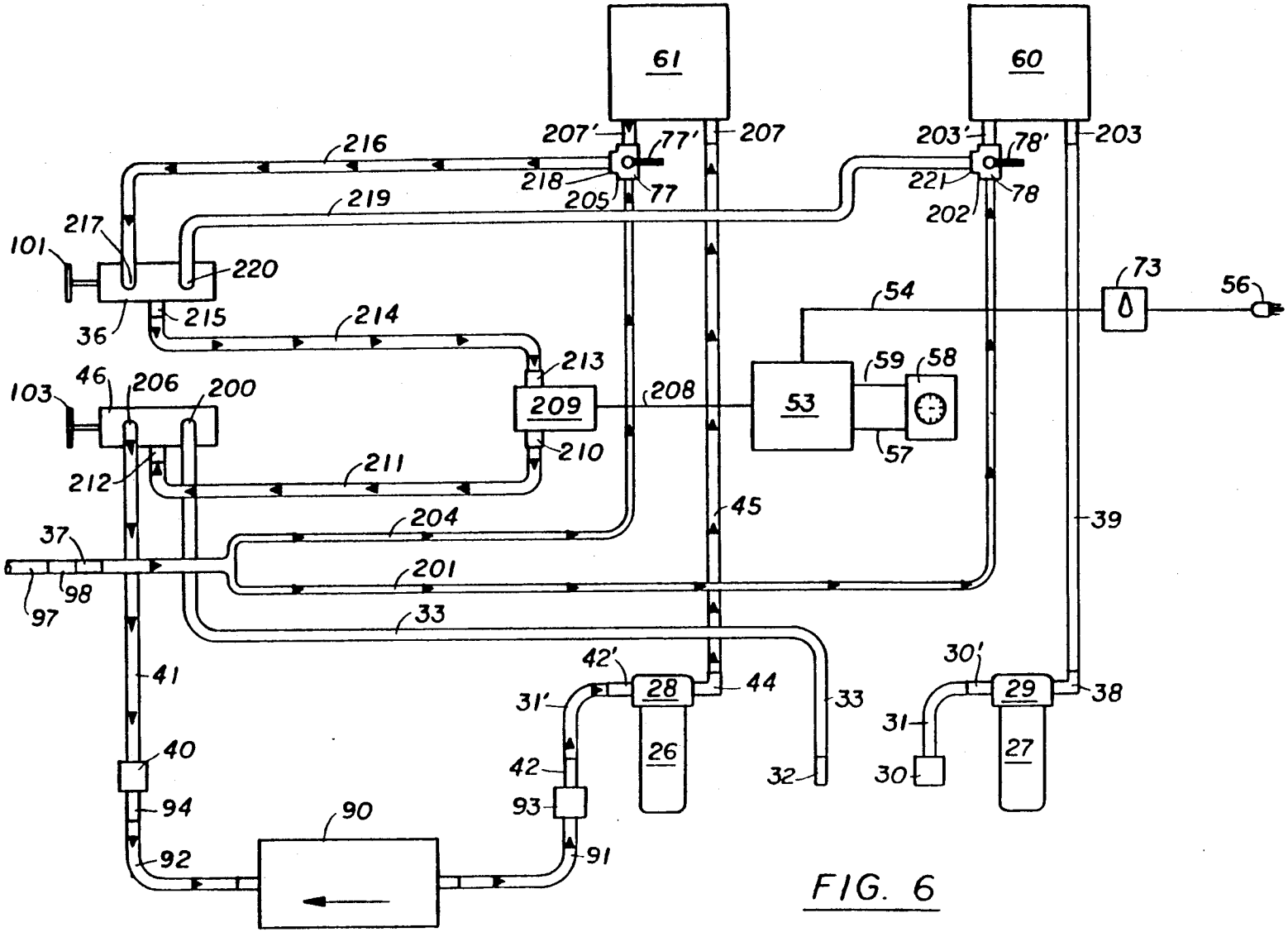
FIG. 6 is a diagram of the interior operating components of the apparatus of the invention illustrating a first phase in the operation thereof.

As seen in FIGS. 1 & 5, a pair of filter canisters 26, 27 having any suitable filters therein are mounted on apparatus 10. Each canister 26, 27 has a sealable screw-threaded top cap, such as caps 28, 29, respectively (FIG. 5). A female quick connect fitting 30 is coupled via hose 31 to fitting 30' leading into the interior of cap 29. A male fitting 32 (see FIG. 6) is coupled via hose 33 to inlet 200 of valve assembly 46. An air inlet 37 (FIG. 2), to which a suitable source of air can be connected is coupled via conduit 201 (FIG. 6) to inlet 202 of lever actuated valve 78, fluidly coupled to compartment 60. Inlet 37 is also fluidly coupled via conduit 204 to inlet 205 of lever actuated valve 77 coupled to compartment 61. As seen in FIGS. 1 and 6, fitting 38 leads from cap 29 coupled via hose 39 to an inlet 203 into compartment 60. Similarly a fitting 44 which leads from cap 28 is coupled via hose 45 to an inlet 207 of compartment 61. Fittings 30 and 32, as well as 40 and 42 are conventional snap-on fittings which open when coupled to a mating connector.

As seen in FIGS. 1 & 6, female fitting 40 is coupled via hose 41 to outlet 206 of valve assembly 46. (Female fitting 40 is similar to female fitting 30). Canister 26 has a male fitting 42, similar to male fitting 32 seen in both FIGS. 1 and 6 associated therewith. This male fitting 42 is coupled via hose 31' to fitting 42' which communicates with the interior of cap 28.

As seen in FIG. 5, indicia, such as indicia plates 49 to 52, may be provided on portion 16 of wall 15 (or at any suitable location) for identifying the various fittings. For example, plate 49 may indicate "solvent out" (for fitting 40); plate 50 may indicate "solvent return" (for fitting 42); plate 51 may indicate "oil return" (for fitting 30); and plate 52 may indicate "oil out" (for fitting 30).

Figure 4:
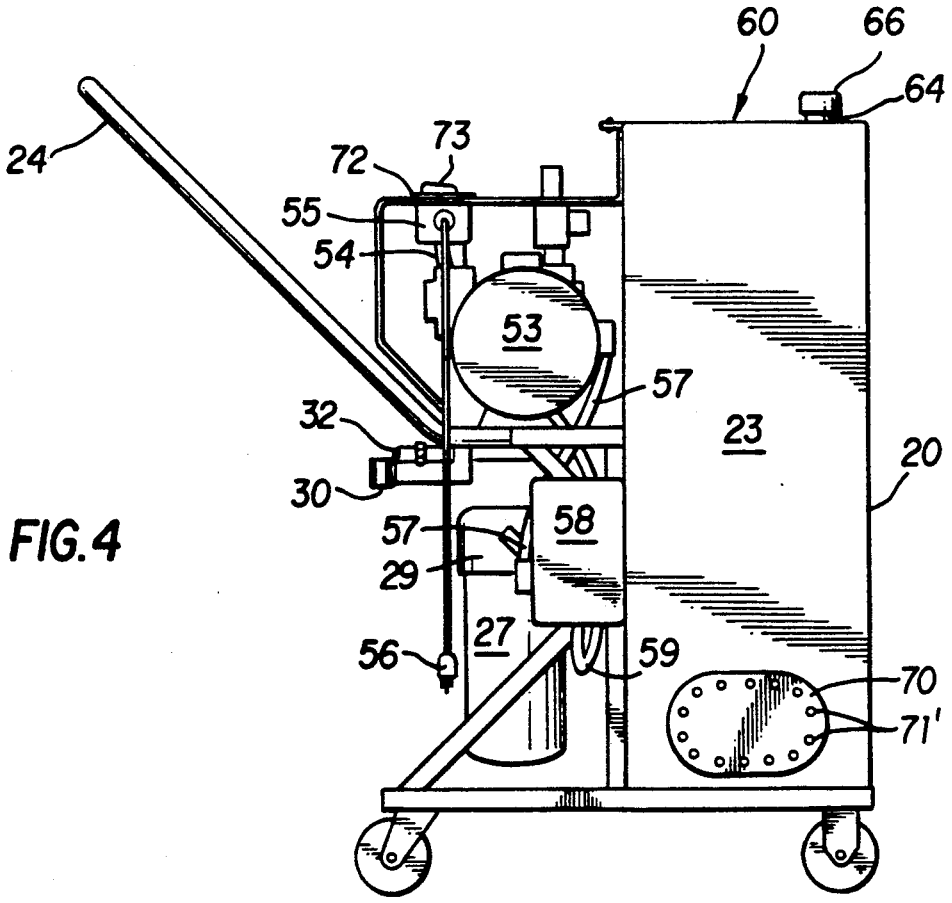
FIG. 4 is a view similar to FIG. 2 showing the opposite side of the apparatus.

As seen in FIGS. 4 & 6, a pump motor 53 is provided in the upper compartment of housing 11 on top of wall 14 coupled via electrical conduit 54 (FIG. 4) to a switch box 55 having a power cord and plug 56 coupled thereto. A second electrical conduit 57 from motor 53 couples the same to a conventional timer 58 (see also FIGS. 5 and 6). An electrical conduit 59 couples timer 58 back to motor 53 (FIG. 6).

As seen in FIG. 6, the pump motor 53 is electrically connected to a power source via conduit 54 which terminates in plug 56. Switch 73 is interposed in the conduit 54. Pump motor 53 is also electrically coupled via conduit 208 to valve 209. One outlet 210 of valve 209 is fluidly coupled via conduit 211 to inlet 212 of valve assembly 46. Inlet 213 of this valve 209 is coupled via conduit 214 to outlet 215 of valve assembly 36. See FIGS. 11 through 13 where such is also shown.

Figure 7:
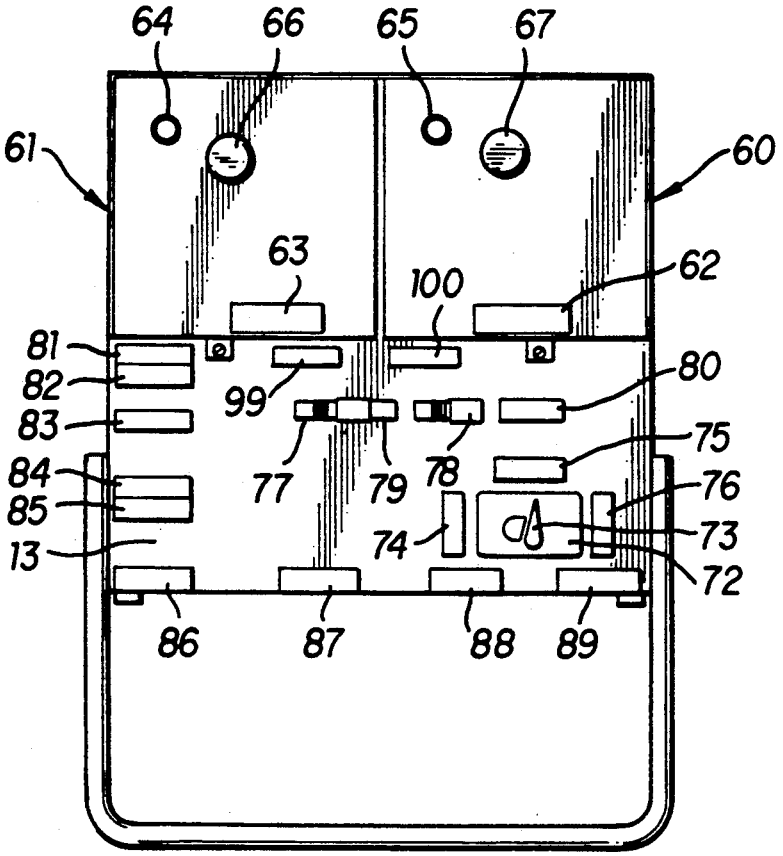
FIG. 7 is a top plan view of the apparatus of the invention.

Each compartment 60, 61 is provided with a source of solvent and oil. That is, compartment 60 (FIG. 3) contains oil, such as conventional transmission oil, in the interior thereof in any suitable manner, and this may be identified as seen in FIG. 7 by an indicating plate 62 indicating "Trans Oil" thereon. In like manner, a suitable cleaning solvent, such as dimethyl ketone, may be provided in the interior of compartment 61 identified by plate 63 indicating "Solvent" thereon. These plates may be of contrasting colors. For example, plate 63 may be yellow and plate 62 black for reasons to be discussed.

Figure 8:
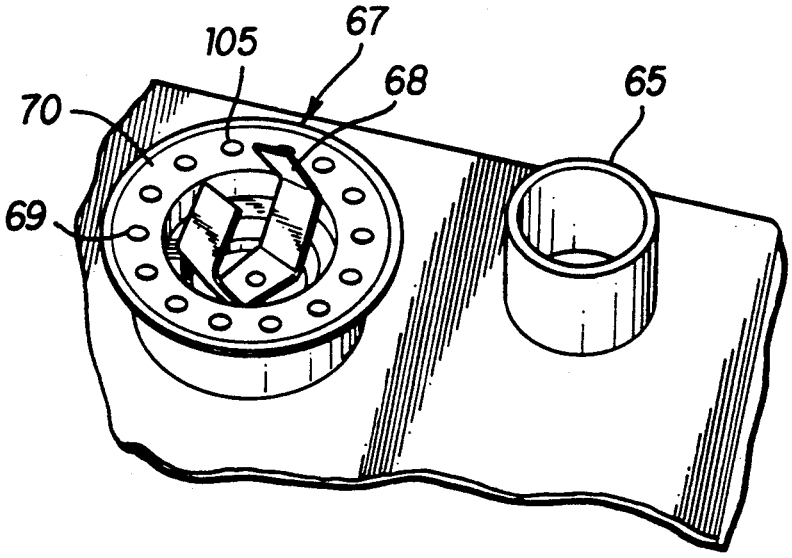
FIG. 8 is a detailed view of a portion of the apparatus of FIG. 7 showing one of the caps removed from the fill tube for convenience of illustration.

Fill tubes 64, 65 are provided on each compartment 61, 60 respectively, at the top thereof for supplying solvent and oil, respectively. Each tube 64, 65 is capped off at the top by filter caps 66, 67 respectively. As seen in FIG. 8, each cap, such as cap 67, has an internal spring clip 68 which resiliently engages the inner cylindrical wall of each fill tube, such as tube 65, to hold the cap in place yet permit easy and quick removal therefrom. Each cap is of double wall construction with a plurality of spaced apertures 69 about the bottom peripheral wall 70 closing off the double wall construction. A suitable filter material 105 may be provided interiorly of the double wall construction.

As seen in FIG. 4, an oval shaped removable plate 70', retained in position by threaded bolts 71, may be provided at the bottom of each compartment 60, 61 (see also FIG. 2) for providing access to the interior thereof wherein the compartments 60, 61 may be drained or the like or otherwise cleaned out. That is, each compartment 60, 61 may include a drain (not shown) at the bottom or otherwise accessible behind plates 70'.

As seen in FIG. 7, a power switch plate 72 having switch 73 may be provided on top of wall 12. Suitable indicia, such as on plates 74 to 76, may be provided, indicating "ON", "POWER" and "OFF", respectively. Plate 72 is of course part of the aforementioned box 55 (FIG. 4). Plates 74 to 76 may be of a color different from plates 62, 63, such as red.

Figure 16:
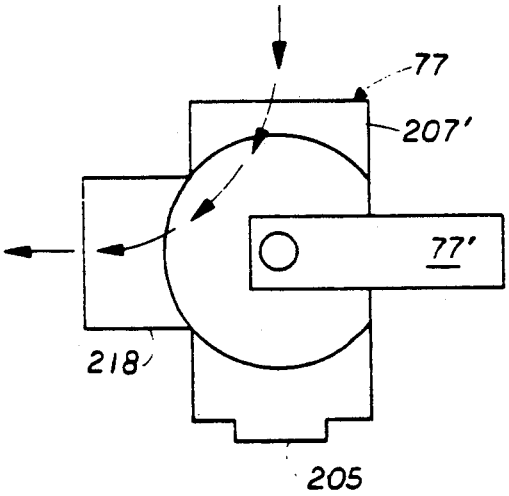
FIG. 16 is a diagrammatic top plan view of valve 77 alone.
Figure 17:
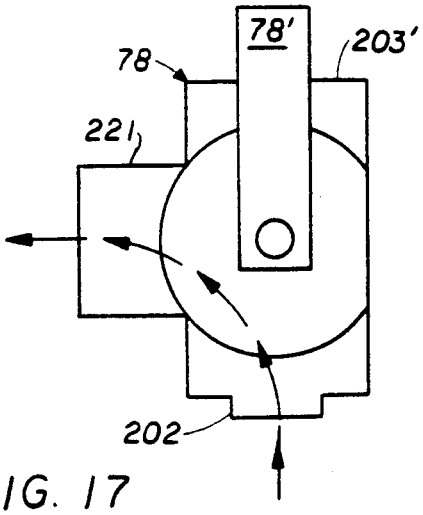
FIG. 17 is a diagrammatic top plan view of valve 78 alone.

Plates 79, 80 may be provided adjacent lever actuated valves 77, 78 respectively, (FIG. 7), which plates have indicia thereon indicating "OFF" (the position of the levers shown in FIG. 7). As seen in FIG. 16, lever 77' of valve 77 is shown in the off or closed position with solvent flow therethrough as indicated by the arrows. As seen in FIG. 17, lever 78' of valve 78 is shown in the "open" or "on" position with oil flow therethrough as indicated by the arrows. This will be discussed further in detail hereinbelow. In FIG. 7 plates 99, 100 rearwardly of plates 79, 80 indicate the "ON" position. These plates may be of a color different from plates 62, 63 and 74 to 76, such as green. A plurality of identifying plates 81 to 85 may be provided on the top of wall 12 along one edge thereof as shown indicating "PUSH OUT SOLVENT", "PUSH OUT OIL", "AIR SUPPLY", "PULL OUT SOLVENT" AND "PUSH IN OIL", respectively.

A plurality of plates 86 to 89 may be provided along the front of wall 12 indicating "SOLVENT OUT", "SOLVENT RETURN", "OIL RETURN", and "OIL OUT", respectively. Plates 86 to 89 correspond to plates 49 to 52, respectively. Plates 49, 50, 81, 84, 86 and 87 may be colored similarly to plate 63, such as yellow. Plates 82, 85, 88 and 89 may be colored similarly to plate 62, such as black. Plate 83 may be colored similarly to plates 79, 80, such as green. Thus, "black" may denote oil; "yellow" may denote solvent; green may denote "air"; and red may denote power. Obviously any other color keying system may be employed as may be desired.

Conduit 216 (FIG. 6) interconnects inlet 217 of valve assembly 36 to inlet 218 of valve 77. Conduit 219 interconnects inlet 220 of valve assembly 36 to inlet 221 of valve 78.

A pair of push in or push out levers 101, 103 (FIGS. 2 & 6) may be provided under plates 81, 82, respectively, coupled to valve assemblies 36, 46, respectively.

Figure 14:
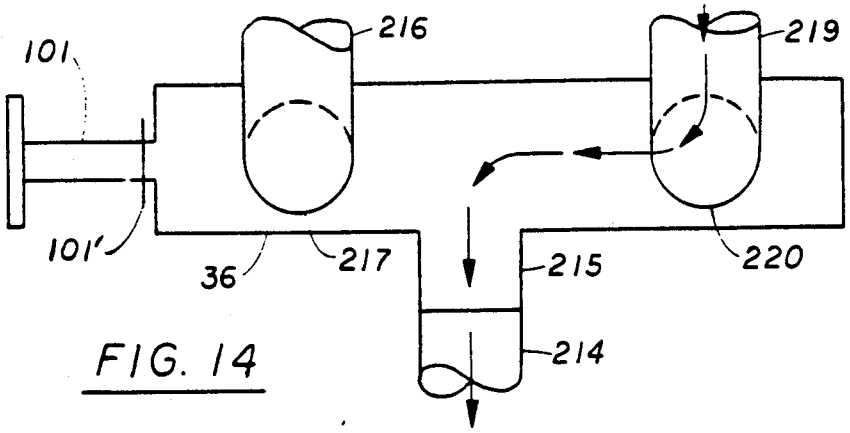
FIG. 14 is a diagrammatic top plan view of lever 101 and valve assembly 36 alone of the invention.
Figure 15:
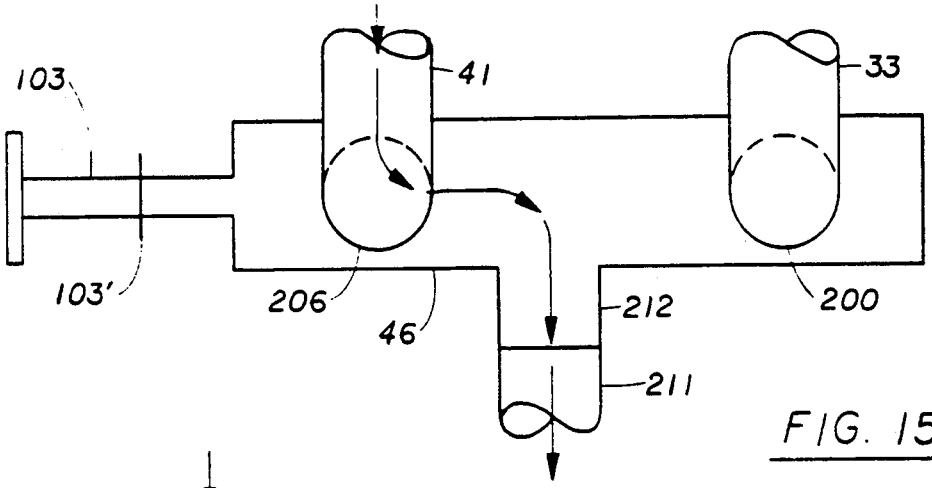
FIG. 15 is a diagrammatic top plan view of lever 103 and valve assembly 46 alone of the invention.

As seen in FIG. 14, a stop 101' is associated with lever 101 (shown in the off position in FIG. 14) and the direction of oil flow through valve assembly 36, to be discussed, via conduits 219, 214 and inlets 220, 215, is indicated by the arrows. Also, as seen in FIG. 15, a stop 103' (shown in the on position in FIG. 15) is associated with lever 103 and solvent flow is shown by the arrows through conduits 41, 211 and inlets 206, 212. Any suitable materials may be used, such as steel, chrome plating, rubber wheels, stainless steel tubing, etc all of which are conventionally employed for apparatuses similar to this one but for different functions.

OPERATION

Figure 9:
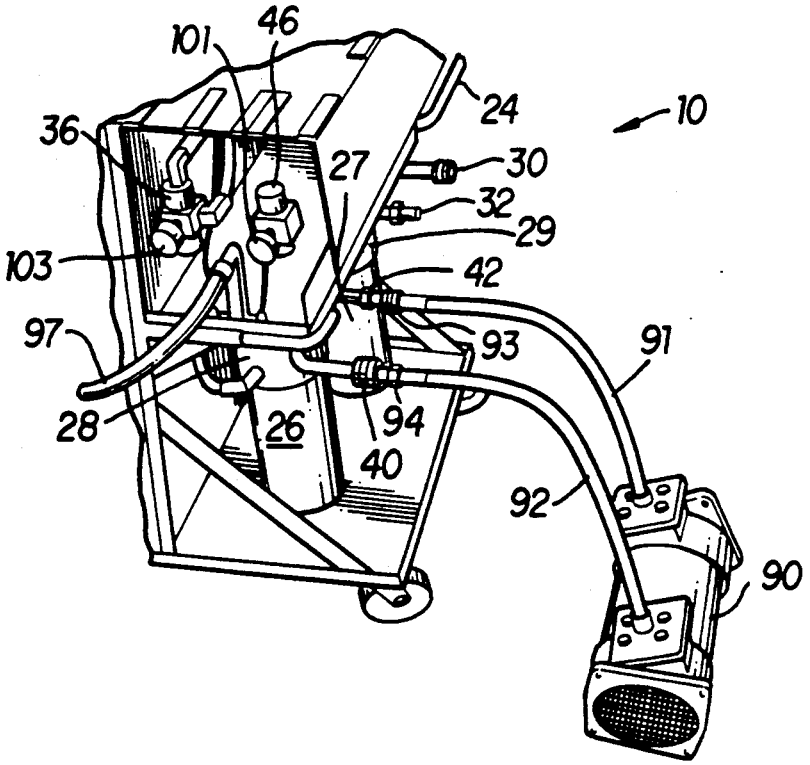
FIGS. 9 and 10 are perspective views showing a conventional heat exchanger removed from a vehicle with its hoses intact utilizing the cleaning apparatus of the invention.
Figure 10:
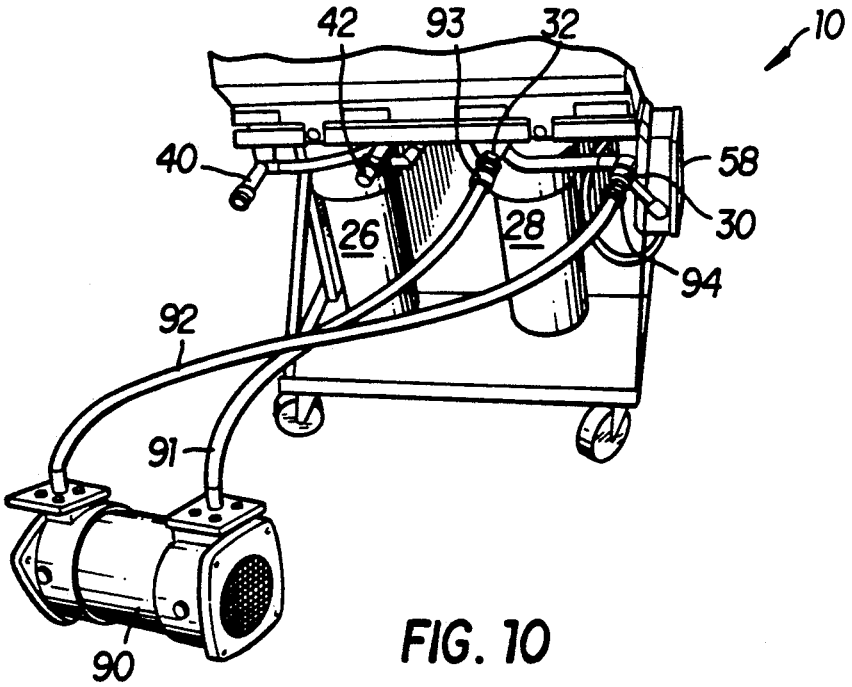

The operation of apparatus 10 will now be discussed. Compartments 60, 61 are filled with solvent and oil to any desired quantity, preferably with some allowance for expansion when air enters the compartments. As seen in FIGS. 6 & 9, a conventional heat exchanger 90 is shown removed from a vehicle or the like and hooked up to apparatus 10. Of course, since apparatus 10 is mobile, it is not necessary to remove the heat exchanger 90 from the vehicle or the like to clean the same. One must merely disconnect it from the transmission system.

Heat exchanger 90 thus has a pair of conventional fluid lines 91, 92 for flowing oil in and out of heat exchanger 90. For example, line 91 may be an "OIL OUT" or "OIL RETURN" line for flowing oil out of heat exchanger 90 and line 92 may be an "OIL IN" or oil feed line for flowing oil through heat exchanger 90 thus providing reverse flow when hooked up as in FIG. 9. Normal oil flow is indicated by the arrow 225, per FIG. 11. Each line 91, 92 is provided with a suitable quick connect fitting at its terminal end. Thus, line 91 is provided with a female terminal fitting 93 adapted to quick connect to male fitting 42 and line 92 is provided with a male terminal fitting 94 adapted to quick connect to female fitting 40. Lines 91, 92 are thus coupled to fittings 42 and 40. If desired, any oil filters on line 91 can be left in place.

The timer 58 (see FIG. 1) is set to the predetermined running and soak or delay times as will be discussed. A suitable supply of air via line 97 with a female quick connect fitting 98 is connected to air inlet fitting 37 (FIGS. 2 & 6) which is preferably a quick connect male fitting. The levers 77', 78' of valves 77, 78 should be in the off or closed position as seen in FIG. 16. Levers 101, 103 are pulled out to "on" position and apparatus 10 is now plugged into a source of electrical power via plug 56. Switch 73 is turned on and solvent is flowed through heat exchanger 90 in the direction of the arrows shown in FIG. 6 in the piping for the predetermined flow time such as fifteen (15) minutes through filter canister 26, where the solvent is filtered, then permitted to return back to solvent compartment 61 via hose line 45. FIG. 16 illustrates the flow through valve 77. The solvent flows at uneven volumes of flow. Timer 58 then shuts off motor 53 for a predetermined "soak" period, such as 15 minutes. Several such "flow" and "soak" cycles may be carried out.

Figure 11:
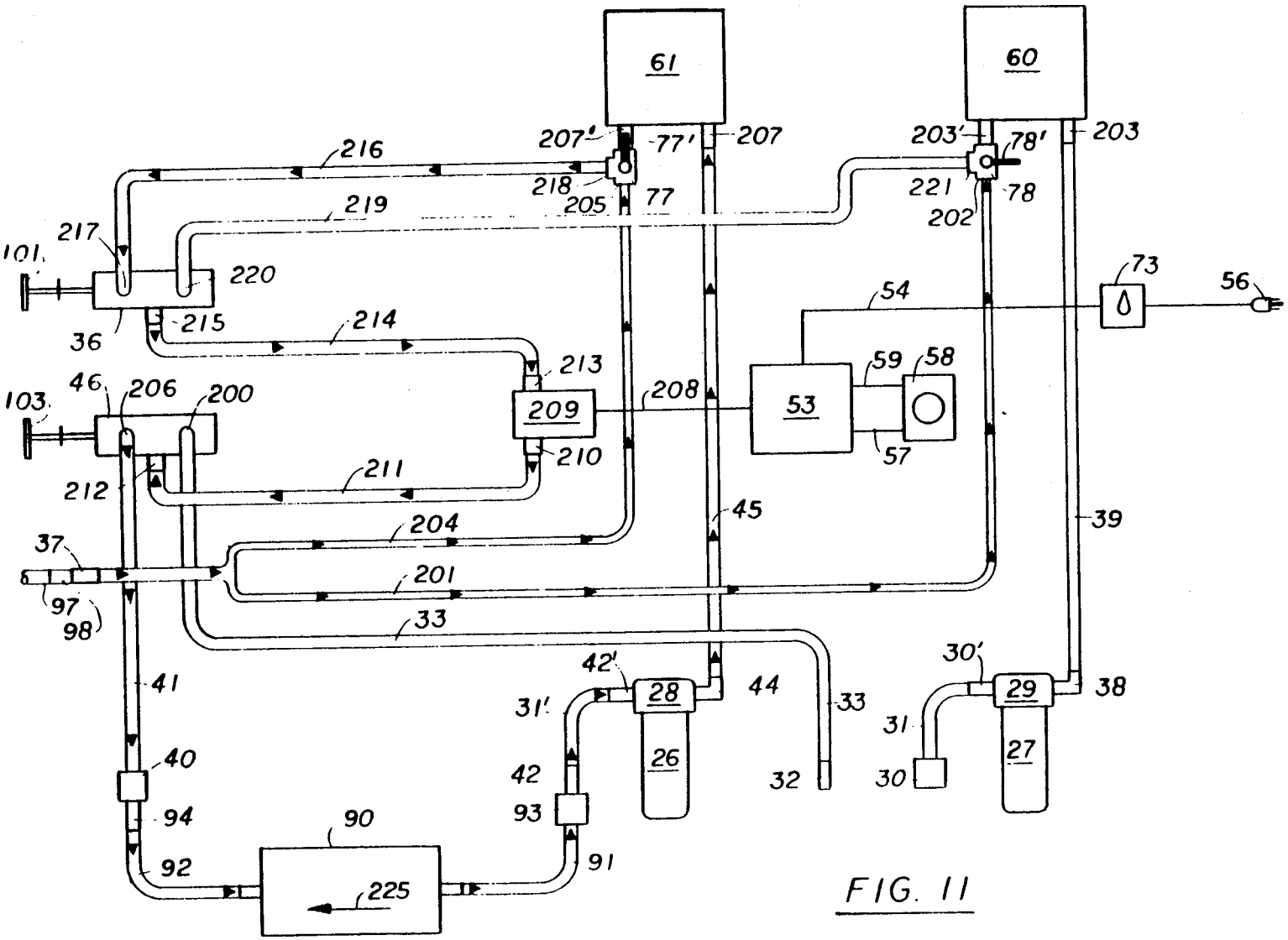
FIGS. 11 to 13 are views similar to FIG. 6 illustrating subsequent phases in the operation thereof.

After the timer shuts off, as seen in FIG. 11, the air cycle is initiated. Motor 53 is shut off via switch 73. Levers 101 and 103 are left in the pulled out "on" position and the lever 77' of valve 77 is moved to the open position (such as liner 78' in FIG. 17). Air is now flowed through the system as indicated by the arrows in FIG. 11 which purges solvent out of the system while cleaning the system. The air is allowed to flow for the aforementioned predetermined period of time and flows in the reverse direction to oil flow through heat exchanger 90 at the end of which time, the lever of valve 77 is closed.

As seen in FIG. !2, the oil cycle is now initiated. Line 92 is disconnected from fitting 40 and connected to fitting 30. Line 91 is disconnected from fitting 42 and connected to fitting 32. Levers 101 and 103 are pushed in against stops 101', 103', respectively, and the operator should ascertain that the levers 77', 78' of valves 77 and 78 are in the closed position. Pump motor 53 is now turned on via switch 73 and oil flows through the system in the direction of the arrows again for the desired predetermined period of time, i.e. normal flow.

Figure 12:
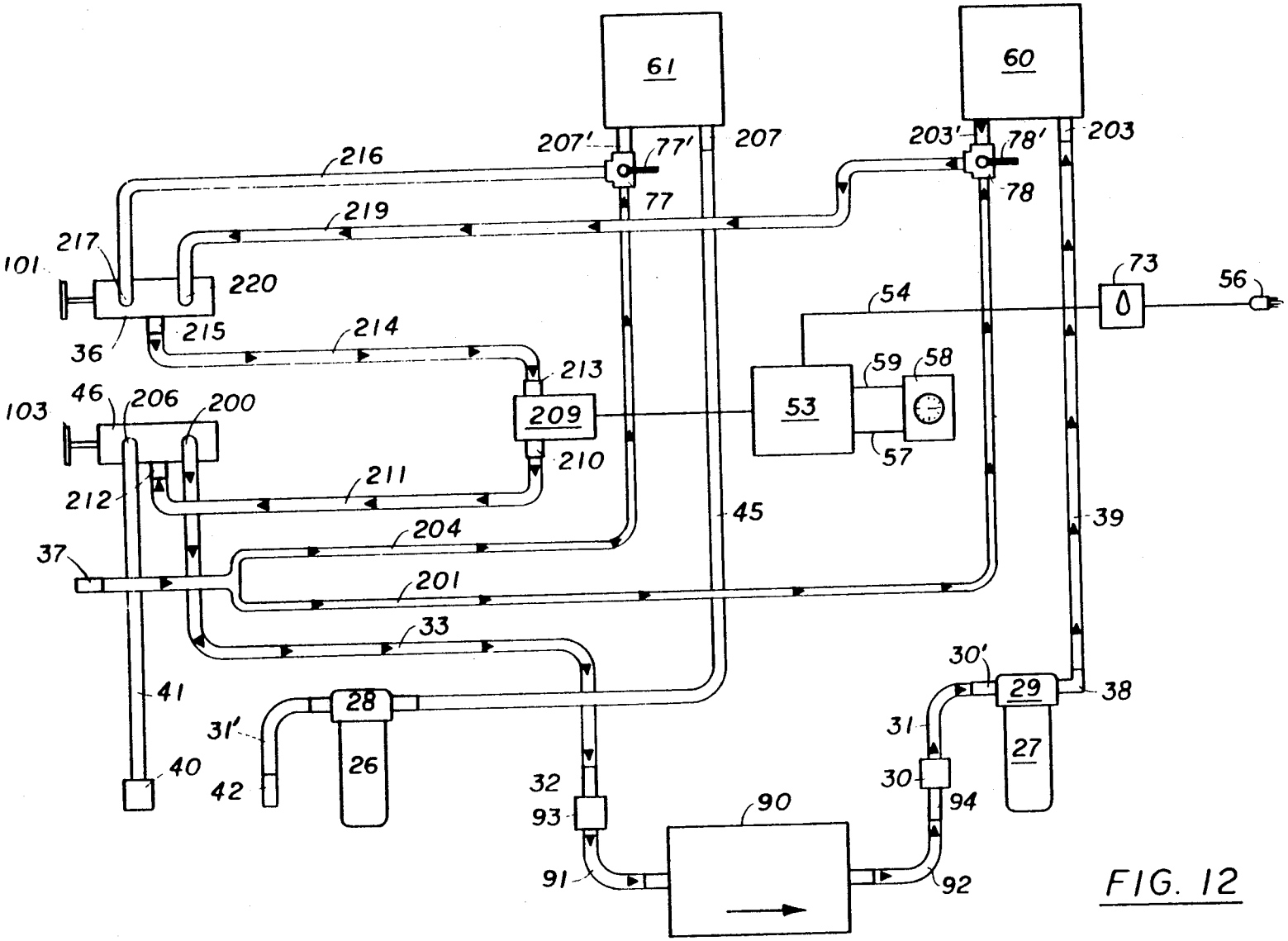
Figure 13:
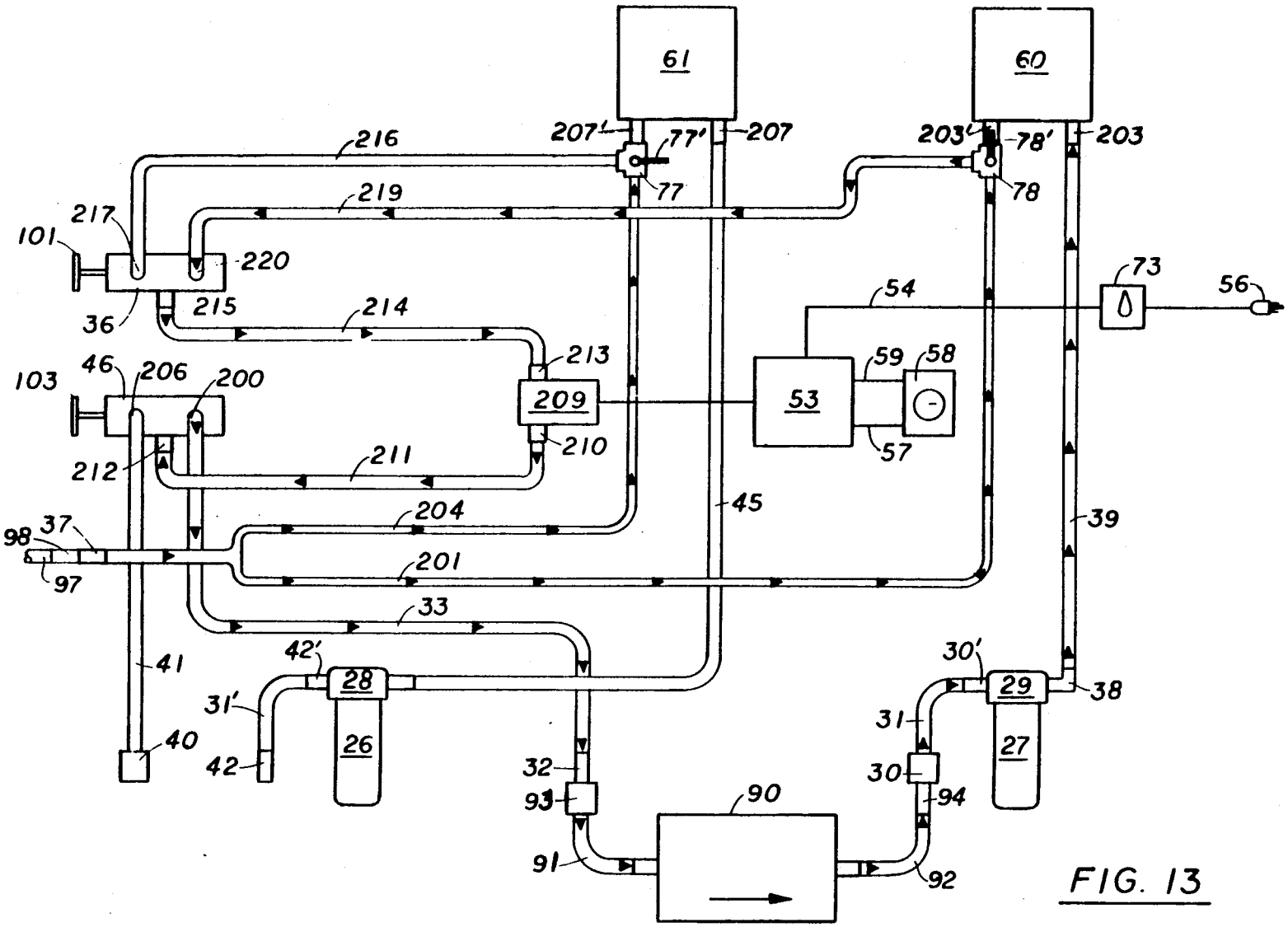

Note however the position of fluid lines 91 and 92 which in FIGS. 12 and 13 are viewed from the opposite side of where they are located on heat exchanger 90 in FIGS. 6 and 11. Thus entry via 91 in FIG. 12 is normal flow when viewed relative to the heat exchanger's flow arrow 225, in FIGS. 6 or 11.

The air cycle is again initiated as seen in FIG. 13. This cycle differs from that of FIG. 11 since it flows through substantially the entire system and is opposite the flow direction or air of FIG. i.e. in via hose 91 for this second air cycle corresponding to the directionality of normal oil flow. Thus, motor 53 is turned off via switch 73. Levers 101 and 103 are left in the pushed in position and the lever 78' of valve 78 is opened. This allows air, coupled via line 97 to inlet 37, to flow through the entire system in the direction of the arrows, (see also FIG. 17). The lever of 78' valve 78 is now closed, lines 91 and 92 are disconnected from fittings 32 and 30, respectively, and the air supply line 97 is disconnected from inlet 37.

Timer 58 may be preset to have a 15 minute flow, a 15 minute soak and 2 or 3 such cycles. Oil and air may be flowed through the system using the same flow and dwell periods. The heat exchanger 90 and all lines and filters coupled thereto are now clean. The quick connect fittings may be removed from lines 91, 92 and the heat exchanger 90 can be reconnected to the transmission.

Although preferred flow and soak times and cycles have been discussed, obviously the system can run for any desired time, such as 20 minutes of flow and 20 minutes of soak. The flow of air breaks up any loose contaminants. Air can be flowed through for any desired time, such as 5 minutes. The transmission filter may be replaced with a new filter before cleaning.

All fittings may be cleaned and hoses for the transmission reinstalled.

The apparatus disclosed herein cleans the entire system, i.e., the heat exchanger 90, all hoses, filters and the reservoir by using cleaning solvent, air pressure and transmission fluid.

Conventional current of 100 to 115 volts may be used. Any suitable air pressure can be used, such as 60 to 75 psi. Any suitable timer may be used, such as a Dayton 2E255 manufactured by Dayton Electric Mfg. Co. of Chicago, Ill. Such a timer can be preset to run on the aforementioned cycles, such as 15 minutes on and off. Any suitable pump motor can be used, such as a 1 hp pump Model 2AP03 manufactured by Roper Co., of Commerce, Ga. Any suitable filter canisters can be used, preferably hydraulic ones having 6 micron capabilities with any suitable filter medium, such as fiberglass. Suitable such filters are manufactured by Pall Co. These filters have a pop-up indicator to indicate when the filters need to be cleaned.

The air injection pushes any solvent or oil remaining in the lines or heat exchanger back into the storage tanks or compartments 60, 61 creating a blasting effect and chipping away any contaminants. If desired, a drip pan may be placed under canisters 26, 27 to catch any drippings.

There thus is discussed a unique apparatus and system for cleaning heat exchangers and all filters and lines coupled thereto. Although there is disclosed a preferred embodiment, such is exemplary only and modifications thereof may occur to an artisan. The scope of the invention is to be determined only by the scope of the appended claims.

I claim:

1. A method for cleaning heat exchangers to remove contaminated oil and contaminants therefrom comprising the steps of:

(a) flowing solvent from a source of solvent for a predetermined period of time through said heat exchanger, in a direction of flow through said heat exchanger opposite the normal direction of flow of fluids through said heat exchanger and back to said source Of solvent;

(b) subsequently stopping the flow of solvent for a predetermined period of time;

(c) subsequently flowing air under pressure through said heat exchanger in the same direction as the aforementioned step of flowing solvent to remove solvent therefrom and force any solvent remaining in said heat exchanger back into said source of solvent;

(d) subsequently flowing oil from a source of oil for a predetermined period of time through said heat exchanger in a normal direction of flow of fluids through said heat exchanger and back into said source of oil;

(e) subsequently stopping the flow of oil for a predetermined period of time; and (f) subsequently flowing air under pressure through said heat exchanger in the same direction as the aforementioned step of flowing oil to remove oil therefrom and force any oil remaining in said heat exchanger back into said source of oil.

2. In the method of claim 1 wherein, in the steps of flowing solvent and oil, and stopping said flow, include the step of carrying out the same for approximate 15 minute periods.

3. In the method of claim 1 wherein, in the steps of flowing oil and solvent, including the step of filtering said oil or solvent being flowed prior to return to the source thereof.

4. In the method of claim 1 including repeating the steps of flowing solvent, and stopping the flow thereof, prior to the step of flowing air to remove solvents.

5. In the method of claim 4 including repeating the steps of flowing oil, and stopping the flow thereof, prior to the step of flowing air to remove oil.

* * * * *